US010332469B2

(12) United States Patent
Li et al.

(10) Patent No.: US 10,332,469 B2
(45) Date of Patent: Jun. 25, 2019

(54) GOA CIRCUIT OVER-CURRENT PROTECTION SYSTEM AND METHOD THEREOF

(71) Applicant: Shenzhen China Star Optoelectronics Technology Co., Ltd., Shenzhen (CN)

(72) Inventors: Wenfang Li, Shenzhen (CN); Xianming Zhang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 75 days.

(21) Appl. No.: 15/569,389

(22) PCT Filed: Jul. 13, 2017

(86) PCT No.: PCT/CN2017/092727

§ 371 (c)(1),
(2) Date: Oct. 26, 2017

(87) PCT Pub. No.: WO2018/209783

PCT Pub. Date: Nov. 22, 2018

(65) Prior Publication Data

US 2019/0108807 A1 Apr. 11, 2019

(30) Foreign Application Priority Data

May 17, 2017 (CN) ..... 2017 1 0348923

(51) Int. Cl.
*G09G 3/36* (2006.01)

(52) U.S. Cl.
CPC ... *G09G 3/3677* (2013.01); *G09G 2310/0289* (2013.01); *G09G 2310/08* (2013.01); *G09G 2330/025* (2013.01); *G09G 2330/045* (2013.01)

(58) Field of Classification Search
CPC ..... G09G 3/3677; G09G 2330/045; G09G 2310/08; G09G 2330/025; G09G 2310/0289
See application file for complete search history.

(56) References Cited

U.S. PATENT DOCUMENTS

2011/0235220 A1* 9/2011 Huang ..... G05F 1/569 361/18
2016/0336847 A1 11/2016 Kim et al.
(Continued)

FOREIGN PATENT DOCUMENTS

CN 102214987 A 10/2011
CN 105304050 A 2/2016
(Continued)

*Primary Examiner* — Jonathan A Boyd
(74) *Attorney, Agent, or Firm* — Leong C. Lei

(57) ABSTRACT

The present invention provides a GOA circuit over-current protection system and method thereof. The over-current protection system for a GOA circuit, which comprises a power management chip and a level-shift chip. The level-shift chip comprises an over-current protection module. The over-current protection module comprises a current comparator, an AND gate circuit, a rising edge pulse delay circuit, a power supply, a voltage comparator, a first switch and a second switch, and a capacitor. With the current comparator to detect a current on the wiring of the clock signal in the GOA circuit, when the current on the wiring of the clock signal in the GOA circuit is too high, the power supply is controlled for charging the capacitor. With the voltage comparator to detect both ends of the capacitor (the first node voltage), when the first node voltage is too high, an over-current protection control signal is outputted to the power supply management chip to control the power management chip to stop supplying power to the GOA circuit, to
(Continued)

perform an over-current protection of the GOA circuit, to avoid the melted phenomenon caused by the short circuit of the GOA circuit.

12 Claims, 1 Drawing Sheet

(56) References Cited

U.S. PATENT DOCUMENTS

| | | | | |
|---|---|---|---|---|
| 2017/0256222 | A1* | 9/2017 | Kuo | G09G 3/3677 |
| 2017/0261800 | A1* | 9/2017 | Zhang | G02F 1/13454 |
| 2018/0151142 | A1* | 5/2018 | Tian | G09G 3/006 |

FOREIGN PATENT DOCUMENTS

| | | | |
|---|---|---|---|
| CN | 105448260 | A | 3/2016 |
| CN | 106169289 | A | 11/2016 |

* cited by examiner

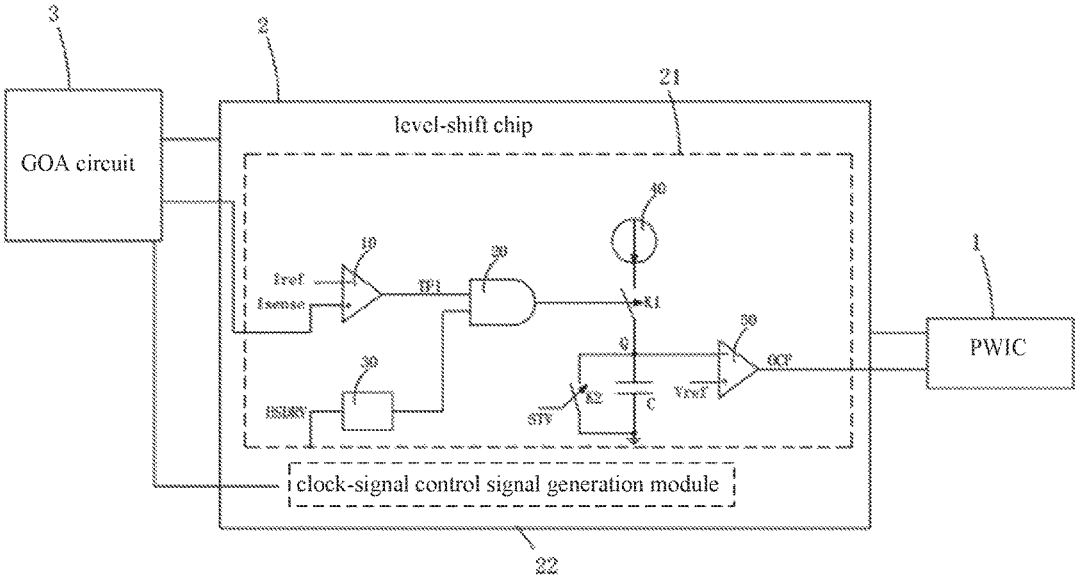
3
2
21
level-shift chip
GOA circuit
1
PWIC
clock-signal control signal generation module
22

GOA CIRCUIT OVER-CURRENT PROTECTION SYSTEM AND METHOD THEREOF

BACKGROUND OF THE INVENTION

Field of Invention

The present invention relates to the field of liquid crystal display, and more particularly to a GOA circuit over-current protection system and method thereof.

Description of Prior Art

The LCD (Liquid Crystal Display) possesses many advantages of being thin case, power saved and radiation free. It has been widely utilized in, such as LCD TVs, mobile phones, Personal Digital Assistant (PDAs), digital cameras, laptop screens or notebook screens. The LCD is at a dominant status in planer display field.

Active Matrix Liquid Crystal Display (AMLCD) is the most commonly used liquid crystal display, which comprises multiple pixels, each pixel is controlled by a thin film transistor (TFT), the gate electrode of the TFT is connected with a scanning line extending in the horizontal direction, the drain electrode of the TFT is connected with a data line extending in the vertical direction, and the source electrode of the TFT is connected with a corresponding pixel electrode. If a enough positive voltage is applied to a certain scanning line in the horizontal direction, all the TFTs connected with the scanning line are opened, the data signal voltage loaded on the data line is written into the pixel electrode, to control the transparency of the different liquid crystal then to achieve the effect of controlling the color.

In the AMLCD, the driven of the horizontal scan line (gate drive) is initially implemented by an external integrated circuit (IC), which can control the step-by-step charging and discharging of all level the horizontal scan lines. The Gate Driver on Array (GOA) technology, in other words, is an array substrate row driving technology, people can use the array process of the liquid crystal display panel to manufacture the driving circuit of the horizontal scan line on the substrate around the display area, hence, it can replace the external IC to complete the driving of the horizontal scan line. The GOA technology can reduce the welding (bonding) process of the external IC welding, have the opportunity to increase production capacity and reduce production cost. Furthermore, the LCD display panel is more suitable for the production of narrow frame display products.

Due to the internal clock signal (CK) of the GOA circuit such as the high alignment and intensive arrangement of the high and low voltage conversion signals, and the influence of the foreign matter on the frame or the impurity particles, the short-circuit risk in the GOA circuit is very high. When short circuit, the voltage difference and the current between the adjacent wirings are very large, the power of the short-circuit point will be very large, causing the panel's temperature rise, when seriously, the melting phenomenon occurs, so the need to perform an Over-current protection (OCP) to the current of the GOA.

SUMMARY OF THE INVENTION

An object of the present invention is to provide an over-current protection system for a GOA circuit, which can perform an over-current protection to the GOA circuit, to avoid a melted phenomenon caused by a short circuit of the GOA circuit.

An object of the present invention is to further provide an over-current protection method for a GOA circuit, applying for the over-current protection system for a GOA circuit, which can perform an over-current protection to the GOA circuit, to avoid a melted phenomenon caused by a short circuit of the GOA circuit.

In order to achieve the objective, the present invention provides an over-current protection system for a GOA circuit, which comprises a power management chip, a level-shift chip electrically connecting with the power management chip, the level-shift chip electrically connecting with a GOA circuit.

The level-shift chip comprises an over-current protection module. The over-current protection module comprises a current comparator, an AND gate circuit, a rising edge pulse delay circuit, a power supply, a voltage comparator, a first switch and a second switch, and a capacitor. A positive-phase input terminal of the current comparator acquires a current on the wiring of the clock signal in the GOA circuit. The reverse-phase input terminal of the current comparator receives a reference current. A first input terminal of the AND gate circuit is electrically connected with an output terminal of the current comparator, a second input terminal of the AND gate circuit is electrically connected with an output terminal of the rising edge pulse delay circuit. An input terminal of the rising edge pulse delay circuit receives a clock-signal control signal. One terminal of the capacitor is electrically connected with a first node and the other terminal of the capacitor is grounded. One terminal of the first switch is electrically connected with the power supply, the other terminal of the first switch is electrically connected with the first node, and a control terminal of the first switch is electrically connected with an output terminal of the AND gate circuit. One terminal of the second switch is electrically connected with the first node, the other terminal of the second switch is grounded, and a control terminal of the second switch receives a start signal of the GOA circuit. A reverse-phase input terminal of the voltage comparator is electrically connected with the first node, a positive-phase input terminal of the voltage comparator receives a reference voltage, and an output terminal of the voltage comparator is electrically connected with the power management chip.

A voltage level of the clock-signal control signal corresponds to a voltage level of the clock signal in the GOA circuit. The power supply management chip supplies power to the GOA circuit via the level-shift chip. When a potential of the first node is higher than the reference voltage, the voltage comparator outputs an over-current protection control signal to the power supply management chip to control the power management chip to stop supplying power to the GOA circuit, to perform an over-current protection of the GOA circuit.

The level-shift chip further provides a clock-signal control signal generation module electrically connected with the over-current protection module, for providing the clock-signal control signal to the GOA circuit and the over-current protection module.

When the output terminal of the AND gate circuit is at high potential, the first switch is closed. When the output terminal of the AND gate circuit is at low potential, the first switch is opened.

When the start signal of the GOA circuit is at high potential, the second switch is closed. When the start signal of the GOA circuit is at low potential and the second switch is opened.

A pulse period of the start signal of the GOA circuit is equal to a duration of one frame scanning of the GOA circuit.

The present invention further provides an over-current protection method for a GOA circuit, applying for the over-current protection system for a GOA circuit as above, which comprises below steps:

Step 1, when the GOA circuit starts a frame scanning, the first switch is closed and then opened under the control of the start signal of the GOA circuit, to clear a potential of the first node.

Step 2, within the frame scanning of the GOA circuit, the current on the wiring of the clock signal in the GOA circuit and the reference current are constantly compared by the current comparator, and a first control signal corresponding to the potential generated according to a comparison result is sent to the first input terminal of the AND gate circuit. The rising edge pulse delay circuit inputs the clock-signal control signal to the second input terminal of the AND gate circuit after a predetermined period of delay time.

When the current on the wiring of the clock signal in the GOA circuit is greater than the reference current, the first control signal is at high potential. When the current on the wiring of the clock signal in the GOA circuit is less than the reference current, the first control signal is at low potential.

Step 3, within the frame scanning of the GOA circuit, the AND gate circuit controls the second switch to be closed and the power supply charges the capacitor for increasing the potential of the first node, when the first control signal and the clock-signal control signal both are at high potential; the AND gate circuit controls second switch to be opened and the power supply stops to charge the capacitor for keeping the potential of the first node the same, when the first control signal or the clock-signal control signal is at low potential.

Step 4, within the frame scanning of the GOA circuit, the potential of the first node and the reference voltage are compared by the voltage comparator. When the potential of the first node is higher than the reference voltage, the over-current protection control signal is outputted to the power supply management chip to control the power management chip to stop supplying power to the GOA circuit, to perform the over-current protection of the GOA circuit.

In the step 3, the AND gate circuit outputs a high potential to make the first switch closed and outputs a low potential to make the first switch open.

In the step 1, when the start signal of the GOA circuit provides a high potential, the second switch is closed; when the start signal of the GOA circuit provides a low potential, the second switch is opened.

A pulse period of the start signal of the GOA circuit is equal to a duration of one frame scanning of the GOA circuit.

The present invention further provides an over-current protection system for a GOA circuit, which comprises a power management chip, a level-shift chip electrically connecting with the power management chip, the level-shift chip electrically connecting with a GOA circuit.

The level-shift chip comprises an over-current protection module. The over-current protection module comprises a current comparator, an AND gate circuit, a rising edge pulse delay circuit, a power supply, a voltage comparator, a first switch and a second switch, and a capacitor. A positive-phase input terminal of the current comparator acquires a current on the wiring of the clock signal in the GOA circuit. The reverse-phase input terminal of the current comparator receives a reference current. A first input terminal of the AND gate circuit is electrically connected with an output terminal of the current comparator, a second input terminal of the AND gate circuit is electrically connected with an output terminal of the rising edge pulse delay circuit. An input terminal of the rising edge pulse delay circuit receives a clock-signal control signal. One terminal of the capacitor is electrically connected with a first node and the other terminal of the capacitor is grounded. One terminal of the first switch is electrically connected with the power supply, the other terminal of the first switch is electrically connected with the first node, and a control terminal of the first switch is electrically connected with an output terminal of the AND gate circuit. One terminal of the second switch is electrically connected with the first node, the other terminal of the second switch is grounded, and a control terminal of the second switch receives a start signal of the GOA circuit. A reverse-phase input terminal of the voltage comparator is electrically connected with the first node, a positive-phase input terminal of the voltage comparator receives a reference voltage, and an output terminal of the voltage comparator is electrically connected with the power management chip.

A voltage level of the clock-signal control signal corresponds to a voltage level of the clock signal in the GOA circuit. The power supply management chip supplies power to the GOA circuit via the level-shift chip. When a potential of the first node is higher than the reference voltage, the voltage comparator outputs an over-current protection control signal to the power supply management chip to control the power management chip to stop supplying power to the GOA circuit, to perform an over-current protection of the GOA circuit.

Wherein, when the output terminal of the AND gate circuit is at high potential, the first switch is closed. When the output terminal of the AND gate circuit is at low potential, the first switch is opened.

A pulse period of the start signal of the GOA circuit is equal to a duration of one frame scanning of the GOA circuit.

The beneficial effects of the present invention are: the present invention provides a GOA circuit over-current protection system and method thereof. The over-current protection system for a GOA circuit, which comprises a power management chip and a level-shift chip. The level-shift chip comprises an over-current protection module. The over-current protection module comprises a current comparator, an AND gate circuit, a rising edge pulse delay circuit, a power supply, a voltage comparator, a first switch and a second switch, and a capacitor. With the current comparator to detect a current on the wiring of the clock signal in the GOA circuit, when the current on the wiring of the clock signal in the GOA circuit is too high, the power supply is controlled for charging the capacitor. With the voltage comparator to detect both ends of the capacitor (the first node voltage), when the first node voltage is too high, an over-current protection control signal is outputted to the power supply management chip to control the power management chip to stop supplying power to the GOA circuit, to perform an over-current protection of the GOA circuit, to avoid the melted phenomenon caused by the short circuit of the GOA circuit.

BRIEF DESCRIPTION OF THE DRAWINGS

For better understanding the technical proposals and other beneficial effects of the present invention, please refer the following detailed description of the present invention with the accompanying drawings.

In drawings:

FIG. 1 is a circuit diagram of over-current protection for a GOA circuit according to the present invention.

DETAILED DESCRIPTION OF THE PREFERRED EMBODIMENTS

The technical proposals and the effects of the present invention will be described in further detail with reference to the below preferred embodiments of the present invention and their accompanying drawings.

Please refer to FIG. 1, the present invention provides an over-current protection system for a GOA circuit, which comprises a power management chip (PMIC) 1, a level-shift chip (level shift IC) 2 electrically connecting with the power management chip 1, the level-shift chip 2 electrically connecting with a GOA circuit 3.

The level-shift chip 2 comprises an over-current protection module 21. The over-current protection module 21 comprises a current comparator 10, an AND gate circuit 20, a rising edge pulse delay circuit 30, a power supply 40, a voltage comparator 50, a first switch K1 and a second switch K2, and a capacitor C. A positive-phase input terminal of the current comparator 10 acquires a current Isense on the wiring of the clock signal in the GOA circuit 3, the reverse-phase input terminal of the current comparator receives a reference current Iref. A first input terminal of the AND gate circuit 20 is electrically connected with an output terminal of the current comparator 10, a second input terminal of the AND gate circuit 20 is electrically connected with an output terminal of the rising edge pulse delay circuit 30. An input terminal of the rising edge pulse delay circuit 30 receives a clock-signal control signal HSDRV. One terminal of the capacitor C is electrically connected with a first node Q and the other terminal of the capacitor C is grounded. One terminal of the first switch K1 is electrically connected with the power supply 40, the other terminal of the first switch K1 is electrically connected with the first node Q, and a control terminal of the first switch K1 is electrically connected with an output terminal of the AND gate circuit 20. One terminal of the second switch K2 is electrically connected with the first node Q, the other terminal of the second switch K2 is grounded, and a control terminal of the second switch K2 receives a start signal STV of the GOA circuit 30. A reverse-phase input terminal of the voltage comparator 50 is electrically connected with the first node Q, a positive-phase input terminal of the voltage comparator 50 receives a reference voltage Vref, and an output terminal of the voltage comparator 50 is electrically connected with the power management chip 1.

Wherein the clock-signal control signal HSDRV is a level control signal of the clock signal in the GOA circuit, the voltage level of the clock-signal control signal corresponds to a voltage level of the clock signal in the GOA circuit. In other words, when the clock-signal control signal HSDRV is at high potential, the clock signal in the GOA circuit is at high potential, too; when the clock-signal control signal HSDRV is at low potential, the clock signal in the GOA circuit is at low potential, too.

The power supply management chip 1 supplies power to the GOA circuit 3 via the level-shift chip 2. When a potential of the first node Q is higher than the reference voltage Vref, the voltage comparator 50 outputs an over-current protection control signal OCF to the power supply management chip 1 to control the power management chip 1 to stop supplying power to the GOA circuit 3, to perform an over-current protection of the GOA circuit 3.

Specifically, the level-shift chip 2 further provides a clock-signal control signal generation module 22 electrically connected with the over-current protection module 21, for providing the clock-signal control signal HSDRV to the GOA circuit 3 and the over-current protection module 21.

Specifically, the first switch K1 and the second switch K2 are both normally open switches. When the output terminal of the AND gate circuit 20 is at high potential, the first switch K1 is closed, and when the output terminal of the AND gate circuit 20 is at low potential, the first switch K1 is opened. When the start signal STV of the GOA circuit is at high potential, the second switch K2 is closed, and when the start signal STV of the GOA circuit is at low potential, the second switch K2 is opened. Specifically, the pulse period of the start signal STV of the GOA circuit is equal to the duration of one frame scanning of the GOA circuit.

It needs to be noted that the operation of the over-current protection system of the GOA circuit of the present invention is: First, the start signal STV of the GOA circuit 3 supplies a high potential, the GOA circuit 3 starts a frame scanning, the second switch K2 is closed and the first node Q is reset to zero, then the start signal STV of the GOA circuit 3 supplies a low potential, the second switch K2 is turned off and the clock-signal control signal HSDRV provides a high potential to the rising edge pulse delay circuit 30 while the clock signal in the GOA circuit 3 is also switched from a low potential to the high potential, and then the rising edge pulse delay circuit 30 outputs a rising edge (the high potential) of the clock-signal control signal HSDRV to the second input terminal of the AND gate circuit 20 after a predetermined period of delay time. Meanwhile, the current comparator 10 compares the reference current Iref with the current on the wiring of the clock signal in the GOA circuit 3 Isense. When the current on the wiring of the clock signal in the GOA circuit 3 Isense is greater than the reference current Iref, a high potential is outputted to the first input terminal of the AND gate circuit 20. Hence, the first and second input terminals of the AND gate circuit 20 are both at high potentials, the output terminal of the AND gate circuit 20 outputs a high potential to the control terminal of the first switch K1 to make the first switch K1 closed and the power supply 40 charge the capacitor C, then, the potential of the first node Q rises continuously. When the potential of the first node Q rises to be greater than the reference voltage Vref, the voltage comparator 50 outputs a over-current protection control signal OCF with a high potential, to control the power supply management chip 2 to stop supplying power to the GOA circuit 3, to perform an over-current protection of the GOA circuit 3.

Furthermore, if the current on the wiring of the clock signal in the GOA circuit 3 Isense is always smaller than the reference current Iref within one frame scanning of the GOA circuit, the current comparator 10 always outputs a low potential to the first input terminal of the AND gate circuit 20, the AND gate circuit 20 always outputs a low potential to the control terminal of the first switch K1, the first switch K1 remains in open state, the power supply 40 is always separated from the capacitor C, and the first node Q is always zero, the over-current protection is always off, and the GOA circuit keeps to normally work.

Within one frame scanning of the GOA circuit, before the potential of the first node Q rises to be larger than the reference voltage Vref and the current on the wiring of the clock signal in the GOA circuit 3 Isense decreases to be smaller than the reference current Iref, the power supply 40 will stop charging the capacitor C, the potential of the first node Q remains unchanged until the GOA circuit start signal STV provides a high potential again when the next frame scanning is started, the first node Q potential is cleared, if the clock-signal control signal HSDRV with a high potential is provided and the current on the wiring of the clock signal in the GOA circuit 3 Isense is larger than the reference Iref, before the next frame scanning, the power supply 40 will continue to charge the capacitor C on the basis of the previous charge, the potential of the first node Q continues to rise until larger than the reference voltage Vref to activate the over-current protection or the start signal STV of the GOA circuit provides a high potential again.

Hence, within one frame scanning of the GOA circuit, when the clock-signal control signal HSDRV is supplied with a high potential and the current on the wiring of the clock signal in the GOA circuit 3 Isense is greater than the reference current Iref, the power supply 40 will charge the capacitor C, to make the potential of the first node Q rises. Furthermore, the multiple charges can be accumulated until the first node Q rises to exceed the reference voltage Vref to activate the over-current protection or the start signal STV of the GOA circuit provides a high potential again, and the potential of the first node Q is clear for the next frame scanning time.

It is worth mentioning that: the current generated by the instantaneous switching of the clock signal from the low potential to the high potential is very large; the current is not caused by short circuit, which should be excluded. Therefore, the present invention provides the rising edge pulse delay circuit 30, the rising edge pulse delay circuit 30 outputs a rising edge (a high potential) of the clock-signal control signal HSDRV to a second input terminal of the AND gate circuit 20 after a predetermined delay time. In other words, after the current on the wiring of the clock signal Isense enters a steady state, the current on the wiring of the clock signal in the GOA circuit 3 Isense is detected and accumulated after exceeding the reference current Iref, to perform the over-current protection.

Based on the over-current protection system for a GOA circuit, the present invention also provides an over-current protection method for a GOA circuit with applying the over-current protection system for a GOA circuit as described above, which comprises below steps:

Step 1, when the GOA circuit 3 starts a frame scanning, the first switch K1 is closed and then opened under the control of the start signal STV of the GOA circuit, to clear a potential of the first node Q.

Specifically, in the step 1, when the GOA circuit 3 starts a frame scanning, the start signal STV of the GOA circuit first supplies a high potential and the second switch K2 is closed and the potential of the first node Q is cleared, then the start signal STV of the GOA circuit supplies a low potential, and the second switch K2 is opened to make the potential of the first node Q can vary with the progress of the scanning process of the GOA circuit 3.

Specifically, the pulse period of the start signal STV of the GOA circuit 3 is equal to the duration of one frame scanning of the GOA circuit 3.

Step 2, within the frame scanning of the GOA circuit 3, the current on the wiring of the clock signal in the GOA circuit Isense and the reference current Iref are constantly compared by the current comparator 10, and a first control signal TP1 corresponding to the potential generated according to a comparison result is sent to the first input terminal of the AND gate circuit 20. The rising edge pulse delay circuit 30 inputs the clock-signal control signal HSDRV to the second input terminal of the AND gate circuit 20 after a predetermined period of delay time.

When the current on the wiring of the clock signal in the GOA circuit Isense is greater than the reference current Iref, the first control signal TP1 is at high potential. When the current on the wiring of the clock signal in the GOA circuit Isense is less than the reference current Iref, the first control signal TP1 is at low potential.

Step 3, within the frame scanning of the GOA circuit 3, the AND gate circuit 20 controls the second switch K2 to be closed and the power supply 40 charges the capacitor C for increasing the potential of the first node Q, when the first control signal TP1 and the clock-signal control signal HSDRV both are at high potential; the AND gate circuit 20 controls second switch K2 to be opened and the power supply 40 stops to charge the capacitor C for keeping the potential of the first node Q the same, when the first control signal TP1 or the clock-signal control signal HSDRV is at low potential.

Specifically, according to the logic operation rule of the AND gate circuit, when the two input terminals of the AND gate circuit 20 are both at high potential, in other words, both the first control signal TP1 and the clock-signal control signal HSDRV, the AND gate circuit 20 outputs a high potential. when the any one of the two input terminals of the AND gate circuit 20 is at low potential, in other words, the first control signal TP1 or the clock-signal control signal HSDRV is at low potential, the AND gate circuit 20 outputs a low potential. Hence, the AND gate circuit 20 is disposed in the step 3 to output a high potential to make the first switch K1 closed, and to output a low potential to make the first switch K1 opened.

Step 4, within the frame scanning of the GOA circuit 3, the potential of the first node Q and the reference voltage Vref are compared by the voltage comparator 50. When the potential of the first node Q is higher than the reference voltage Vref, the over-current protection control signal OCF is outputted to the power supply management chip 1 to control the power management chip 1 to stop supplying power to the GOA circuit 3, to perform the over-current protection of the GOA circuit.

As mentioned above, the present invention provides a GOA circuit over-current protection system and method thereof. The over-current protection system for a GOA circuit, which comprises a power management chip and a level-shift chip. The level-shift chip comprises an over-current protection module. The over-current protection module comprises a current comparator, an AND gate circuit, a rising edge pulse delay circuit, a power supply, a voltage comparator, a first switch and a second switch, and a capacitor. With the current comparator to detect a current on the wiring of the clock signal in the GOA circuit, when the current on the wiring of the clock signal in the GOA circuit is too high, the power supply is controlled for charging the capacitor. With the voltage comparator to detect both ends of the capacitor (the first node voltage), when the first node voltage is too high, an over-current protection control signal is outputted to the power supply management chip to control the power management chip to stop supplying power to the GOA circuit, to perform an over-current protection of the GOA circuit, to avoid the melted phenomenon caused by the short circuit of the GOA circuit.

As mentioned above, those of ordinary skill in the art, without departing from the spirit and scope of the present invention, can make various kinds of modifications and variations to the present invention. Therefore, all such modifications and variations are intended to be included in the protection scope of the appended claims of the present invention.

What is claimed is:

1. An over-current protection system for a GOA circuit, comprising a power management chip, a level-shift chip electrically connecting with the power management chip, the level-shift chip electrically connecting with a GOA circuit;

the level-shift chip comprising an over-current protection module; the over-current protection module comprising a current comparator, an AND gate circuit, a rising edge pulse delay circuit, a power supply, a voltage comparator, a first switch and a second switch, and a capacitor; a positive-phase input terminal of the current comparator acquiring a current on the wiring of the clock signal in the GOA circuit, the reverse-phase input terminal of the current comparator receiving a reference current; a first input terminal of the AND gate circuit electrically connecting with an output terminal of the current comparator, a second input terminal of the AND gate circuit electrically connecting with an output terminal of the rising edge pulse delay circuit; an input terminal of the rising edge pulse delay circuit receiving a clock-signal control signal; one terminal of the capacitor electrically connecting with a first node and the other terminal of the capacitor grounding; one terminal of the first switch electrically connecting with the power supply, the other terminal of the first switch electrically connecting with the first node, and a control terminal of the first switch electrically connecting with an output terminal of the AND gate circuit; one terminal of the second switch electrically connecting with the first node, the other terminal of the second switch grounding, and a control terminal of the second switch receiving a start signal of the GOA circuit; a reverse-phase input terminal of the voltage comparator electrically connecting with the first node, a positive-phase input terminal of the voltage comparator receiving a reference voltage, and a output terminal of the voltage comparator electrically connecting with the power management chip;

wherein a voltage level of the clock-signal control signal corresponds to a voltage level of the clock signal in the GOA circuit; the power supply management chip supplies power to the GOA circuit via the level-shift chip; when a potential of the first node is higher than the reference voltage, the voltage comparator outputs an over-current protection control signal to the power supply management chip to control the power management chip to stop supplying power to the GOA circuit, to perform an over-current protection of the GOA circuit.

2. The over-current protection system for a GOA circuit according to claim 1, wherein the level-shift chip further provides a clock-signal control signal generation module electrically connected with the over-current protection module, for providing the clock-signal control signal to the GOA circuit and the over-current protection module.

3. The over-current protection system for a GOA circuit according to claim 1, wherein when the output terminal of the AND gate circuit is at high potential, the first switch is closed; when the output terminal of the AND gate circuit is at low potential, the first switch is opened.

4. The over-current protection system for a GOA circuit according to claim 3, wherein when the start signal of the GOA circuit is at high potential, the second switch is closed; when the start signal of the GOA circuit is at low potential, and the second switch is opened.

5. The over-current protection system for a GOA circuit according to claim 1, wherein a pulse period of the start signal of the GOA circuit is equal to a duration of one frame scanning of the GOA circuit.

6. An over-current protection method for a GOA circuit, applying for the over-current protection system for a GOA circuit according to claim 1, comprising:

step 1, when the GOA circuit starts a frame scanning, closing and then opening the first switch under the control of the start signal of the GOA circuit, to clear a potential of the first node;

step 2, within the frame scanning of the GOA circuit, constantly comparing the current on the wiring of the clock signal in the GOA circuit and the reference current by the current comparator, and generating a first control signal corresponding to the potential according to a comparison result and sending to the first input terminal of the AND gate circuit; the rising edge pulse delay circuit inputting the clock-signal control signal to the second input terminal of the AND gate circuit after a predetermined period of delay time;

wherein when the current on the wiring of the clock signal in the GOA circuit is greater than the reference current, the first control signal is at high potential; when the current on the wiring of the clock signal in the GOA circuit is less than the reference current, the first control signal is at low potential;

step 3, within the frame scanning of the GOA circuit, controlling the second switch to be closed and the power supply to charge the capacitor for increasing the potential of the first node by the AND gate circuit, when the first control signal and the clock-signal control signal both being at high potential; controlling the second switch to be opened and the power supply stops to charge the capacitor for keeping the potential of the first node the same by the AND gate circuit, when the first control signal or the clock-signal control signal being at low potential;

step 4, within the frame scanning of the GOA circuit, comparing the potential of the first node and the reference voltage by the voltage comparator, when the potential of the first node is higher than the reference voltage, outputting the over-current protection control signal to the power supply management chip to control the power management chip to stop supplying power to the GOA circuit, to perform the over-current protection of the GOA circuit.

7. The over-current protection method for a GOA circuit according to claim 6, wherein in the step 3, the AND gate circuit outputs a high potential to make the first switch closed and outputs a low potential to make the first switch open.

8. The over-current protection method for a GOA circuit according to claim 6, wherein in the step 1, when the start signal of the GOA circuit provides a high potential, the second switch is closed; when the start signal of the GOA circuit provides a low potential, the second switch is opened.

9. The over-current protection method for a GOA circuit according to claim 6, wherein a pulse period of the start signal of the GOA circuit is equal to a duration of one frame scanning of the GOA circuit.

10. An over-current protection system for a GOA circuit, comprising a power management chip, a level-shift chip electrically connecting with the power management chip, the level-shift chip electrically connecting with a GOA circuit;

the level-shift chip comprising an over-current protection module; the over-current protection module comprising a current comparator, an AND gate circuit, a rising edge pulse delay circuit, a power supply, a voltage comparator, a first switch and a second switch, and a capacitor; a positive-phase input terminal of the current comparator acquiring a current on the wiring of the clock signal in the GOA circuit, the reverse-phase input terminal of the current comparator receiving a reference current; a first input terminal of the AND gate circuit electrically connecting with an output terminal of the current comparator, a second input terminal of the AND gate circuit electrically connecting with an output terminal of the rising edge pulse delay circuit; an input terminal of the rising edge pulse delay circuit receiving a clock-signal control signal; one terminal of the capacitor electrically connecting with a first node and the other terminal of the capacitor grounding; one terminal of the first switch electrically connecting with the power supply, the other terminal of the first switch electrically connecting with the first node, and a control terminal of the first switch electrically connecting with an output terminal of the AND gate circuit; one terminal of the second switch electrically connecting with the first node, the other terminal of the second switch grounding, and a control terminal of the second switch receiving a start signal of the GOA circuit; a reverse-phase input terminal of the voltage comparator electrically connecting with the first node, a positive-phase input terminal of the voltage comparator receiving a reference voltage, and a output terminal of the voltage comparator electrically connecting with the power management chip;

wherein a voltage level of the clock-signal control signal corresponds to a voltage level of the clock signal in the GOA circuit; the power supply management chip supplies power to the GOA circuit via the level-shift chip; when a potential of the first node is higher than the reference voltage, the voltage comparator outputs an over-current protection control signal to the power supply management chip to control the power management chip to stop supplying power to the GOA circuit, to perform an over-current protection of the GOA circuit;

wherein when the output terminal of the AND gate circuit is at high potential, the first switch is closed; when the output terminal of the AND gate circuit is at low potential, the first switch is opened;

wherein a pulse period of the start signal of the GOA circuit is equal to a duration of one frame scanning of the GOA circuit.

11. The over-current protection system for a GOA circuit according to claim 10, wherein the level-shift chip further provides a clock-signal control signal generation module electrically connected with the over-current protection module, for providing the clock-signal control signal to the GOA circuit and the over-current protection module.

12. The over-current protection system for a GOA circuit according to claim 10, wherein when the start signal of the GOA circuit is at high potential, the second switch is closed; when the start signal of the GOA circuit is at low potential, and the second switch is opened.

* * * * *